US007661854B1

(12) United States Patent
Yang et al.

(10) Patent No.: US 7,661,854 B1
(45) Date of Patent: Feb. 16, 2010

(54) LED LAMP

(75) Inventors: Ri-Lang Yang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/409,506

(22) Filed: Mar. 24, 2009

(30) Foreign Application Priority Data

Aug. 27, 2008 (CN) ..... 200810304221

(51) Int. Cl.
*F21V 29/00* (2006.01)

(52) U.S. Cl. ..... 362/373; 362/294; 362/249.02

(58) Field of Classification Search ..... 362/218, 362/294, 249.01, 249.02, 373
See application file for complete search history.

(56) References Cited

U.S. PATENT DOCUMENTS

| | | | | |
|---|---|---|---|---|
| 7,465,066 | B2 * | 12/2008 | Chen | 362/267 |
| 7,534,015 | B2 * | 5/2009 | Xu et al. | 362/373 |
| 2009/0097241 | A1 * | 4/2009 | Xu et al. | 362/234 |
| 2009/0213592 | A1 * | 8/2009 | Zhang et al. | 362/249.02 |

* cited by examiner

*Primary Examiner*—Thomas M Sember
(74) *Attorney, Agent, or Firm*—Frank R. Niranjan

(57) ABSTRACT

An LED lamp comprises a heat sink with a plurality of LED modules attached thereon, an envelope receiving the heat sink and the LED modules, and a top cover and a bottom cover mounted at two ends of the heat sink via a plurality of fasteners and shafts with an elastic member coiled therearound. The top cover, the envelope and the bottom cover cooperatively form a sealed space receiving the heat sink and the LED modules. When the fasteners are fastened toward the heat sink, the shafts move upwardly relative to the bottom cover, whereby a distance between the top cover and the heat sink is decreased, so the heat sink makes tight contact with the top cover.

15 Claims, 4 Drawing Sheets

LED LAMP

BACKGROUND

1. Field of the Disclosure

The present disclosure generally relates to LED (light emitting diode) lighting, and more particularly, to an LED lamp having good heat conductivity and seal.

2. Description of Related Art

An LED lamp is a type of solid-state lighting that utilizes LEDs as a source of illumination. The LED lamp is intended to be a cost-effective yet high quality replacement for incandescent and fluorescent lamps due to long-term reliability, environmental friendliness, and low power consumption.

When LED lamps, utilizing a plurality of LEDs, are deployed for exterior use, mist, dust, rainwater and other foreign matters may enter the LED lamp, causing possible electric leakage or short circuit and contamination of the LEDs. A waterproof structure is thus needed to seal the LEDs. In addition, during use, heat generated by the LEDs must be dissipated quickly to prevent damage or operational instability. Often, a heat sink is disposed for the LEDs, attached to the outer surface thereof.

However, in assembly, manufacture or transportation of the LED lamp, assembly or machining errors or other contributing factors can affect the integrity of seal and heat dissipation together or alternatively. Specifically, although the LEDs are sealed heat generated cannot be dissipated efficiently, or when the heat generated by the LEDs is dissipated quickly, foreign contaminants can enter the LED lamp.

What is needed, therefore, is an LED lamp addressing the limitations described.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
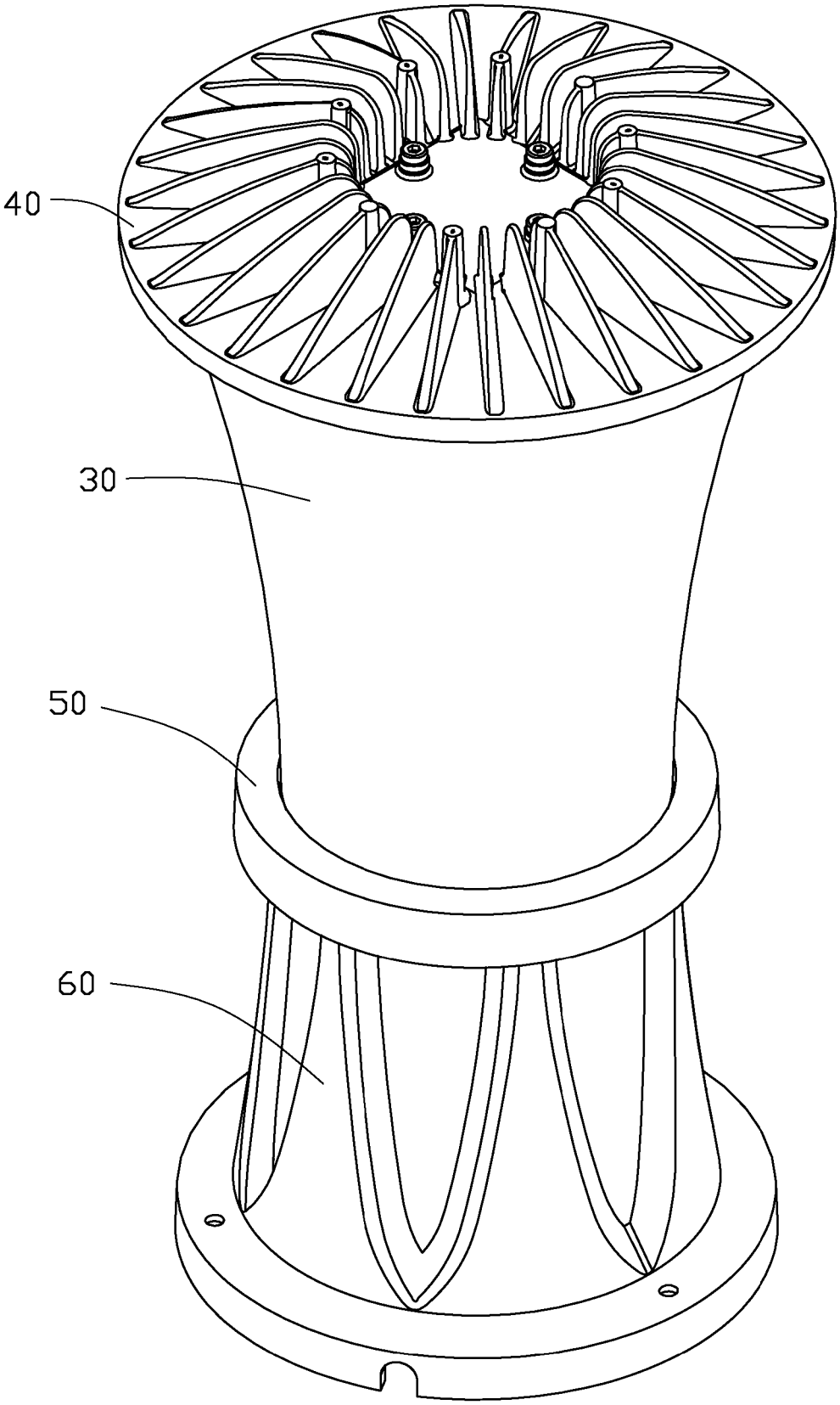
FIG. 1 is an assembled, enlarged view of an LED lamp in accordance with an embodiment of the present disclosure.
Figure 2:
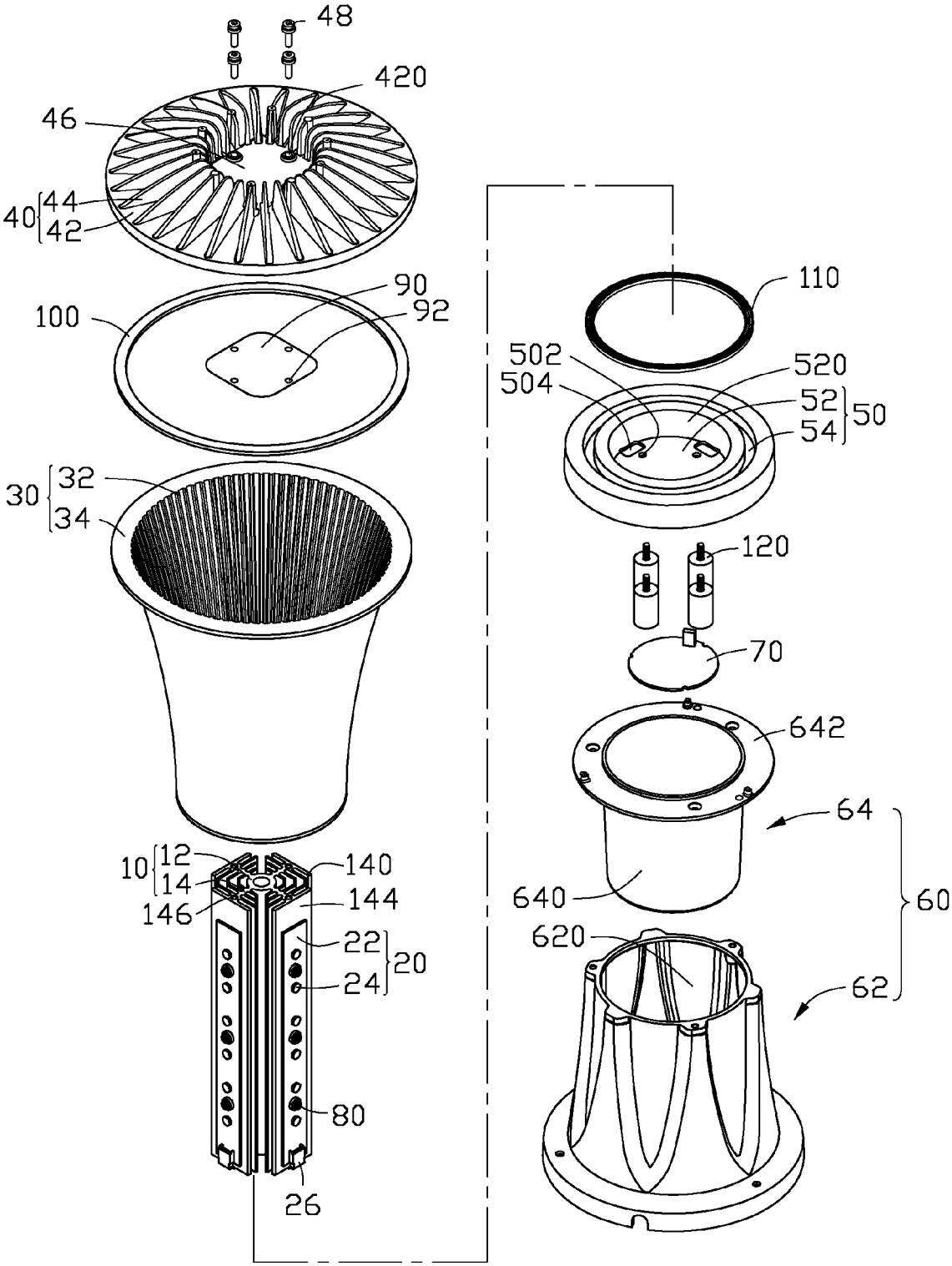
FIG. 2 is an exploded, isometric view of the LED lamp of FIG. 1.

As shown in FIGS. 1-2, an LED lamp in accordance with an embodiment of the present disclosure is provided for exterior use. The LED lamp comprises a heat sink 10, a plurality of LED modules 20 attached onto an outer surface of the heat sink 10, an envelope 30 receiving the heat sink 10 and the LED modules 20 therein, a top cover 40 and a bottom cover 50 disposed at two ends of the envelope 30, and a lamp holder 60 supporting the bottom cover 50, the envelope 30 and the top cover 40. The top cover 40, the bottom cover 50 and the envelope 30 cooperatively form a sealed space (not labeled) receiving the heat sink 10 and the LED modules 20 therein. A driving circuit board 70 is received in the lamp holder 60 and electrically connects with the LED modules 20.

The heat sink 10 is integrally formed of metal with good heat conductivity, such as aluminum or copper. The heat sink 10 has a heat-conductive member at a center thereof. The heat-conductive member is an elongated cylinder 12 with a through hole (not labeled) defined in a center thereof. The heat sink 10 has a plurality of conducting arms 14 extending outwardly from an outer wall of the cylinder 12. The conducting arms 14 are symmetric relative to a central axis of the cylinder 12. The quantity of the conducting arms 14 depends on that of the LED modules 20. In this embodiment, the quantity of conducting arms 14 is four. A plurality of pairs of fins 140 extends perpendicularly from two opposite lateral sides of each of the conducting arms 14. Each pair of the fins 140 is symmetrical relative to the corresponding conducting arm 14. Lengths of the fins 140 increase along an orientation from the cylinder 12 to a distal end of the corresponding conducting arm 14. Each pair of outermost fins 140 cooperatively forms a plane 144 receiving a corresponding LED module 20 thereon. A plurality of threaded holes 146 is defined at top and bottom ends each of the conducting arm 14, respectively. A square conducting piece 90 of metal with good heat conductivity is mounted on a top end of the heat sink 10. The conducting piece 90 defines a plurality of extending holes 92 therein corresponding to the threaded holes 146 defined at the top end of the conducting arms 14.

Each of the LED modules 20 includes a rectangular circuit board 22 and a plurality of LEDs 24 mounted thereon. A socket 26 is disposed at a bottom end of the circuit board 22, which is electrically connected with the driving circuit board 70 via the socket 26. The circuit boards 22 of the LED modules 20 are secured on the plane 144 of the heat sink 10 via a plurality of fasteners 80.

The envelope 30 is made of transparent material, such as plastic, glass or other suitable light-transmissive material. The envelope 30 is substantially cylindrical with an upper opening (not labeled) larger than a lower opening (not labeled) at a bottom end thereof. The envelope 30 has a plurality of elongated protrusions 32 extending inwardly from an inner wall thereof. The protrusions 32 are symmetrical relative to a central axis of the envelope 30. An annular rim 34 extends outwardly from and parallel to a top edge of the envelope 30, supporting the top cover 40.

Figure 3:
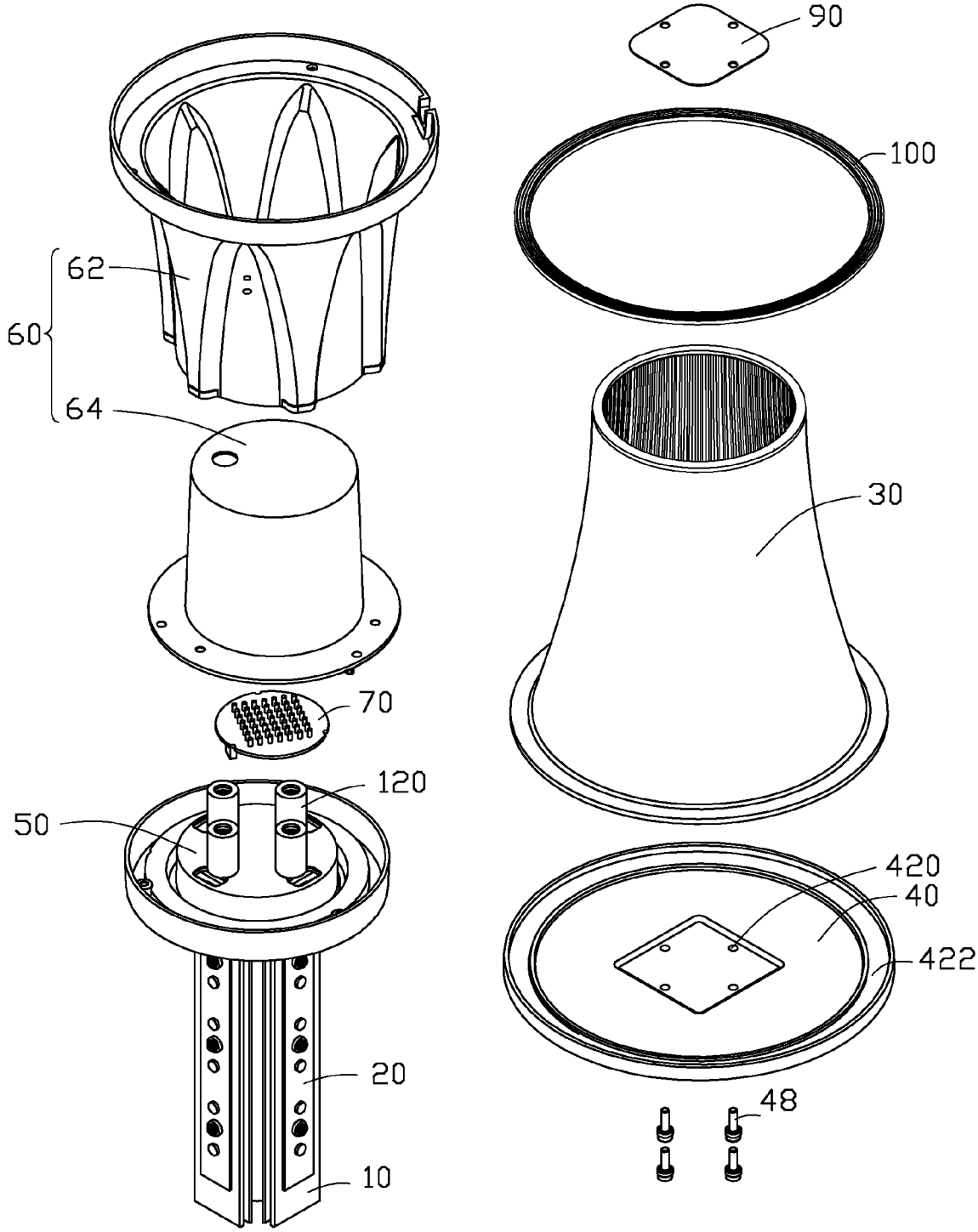
FIG. 3 is a partially assembled, isometric view of the LED lamp of FIG. 2 viewed from an inverted aspect.

Referring also to FIG. 3, the top cover 40 includes a disc-like heat spreader 42 and a plurality of fins 44 extending upwardly and radially from a top surface of the heat spreader 42. The fins 44 are symmetrical relative to a central axis of the heat spreader 42. Inner ends of the fins 44 are spaced from a center of the heat spreader 42 to define a substantially square bare area 46. Height of each fin 44 decreases along an axis from the bare area 46 towards an outer edge of the heat spreader 42. The heat spreader 42 defines a plurality of through holes 420 on the bare area 46 thereof corresponding to the extending holes 92. The heat spreader 42 defines a groove 422 in a bottom surface thereof, receiving the rim 34 of the envelope 30 therein. A first waterproof pad 100 is sandwiched between the groove 422 of the top cover 40 and the rim 34 of the envelope 30.

The bottom cover 50 is a disc-like shell. The bottom cover 50 has a depression 52 defined in a center of a top portion thereof to receive a bottom end of the heat sink 10 therein. The bottom cover 50 corresponding to the depression 52 defines a plurality of through holes 502 corresponding to the threaded holes 146 defined in the bottom end of the heat sink 10. A plurality of rectangular holes 504 are defined between the through holes 502 and a lateral wall 520 of the depression 52 through which an electrical wire of the driving circuit board 70 extends. An annular receiving slot 54 is formed around the depression 52 and spaced from the depression 52 receiving the bottom end of the envelope 30. A second waterproof pad 110 is sandwiched between the receiving slot 54 and the bottom end of the envelope 30, enabling second waterproof pad 110 and first waterproof pad 100 to cooperatively prevent foreign matter, such as mist or dust, from entering the LED lamp.

The lamp holder 60 comprises a seat 62 and a barrel 64 mounted thereon. The driving circuit board 70 is received in the barrel 64. The barrel 64 comprises a body 640 and a connecting flange 642 extending outwardly and horizontally from a top edge of the body 640. The seat 62 is substantially cylindrical and defines a receiving space 620 for the body 640 of barrel 64 therein. The connecting flange 642 is mounted on a top portion of the seat 62 via a plurality of fasteners (not shown).

Figure 4:
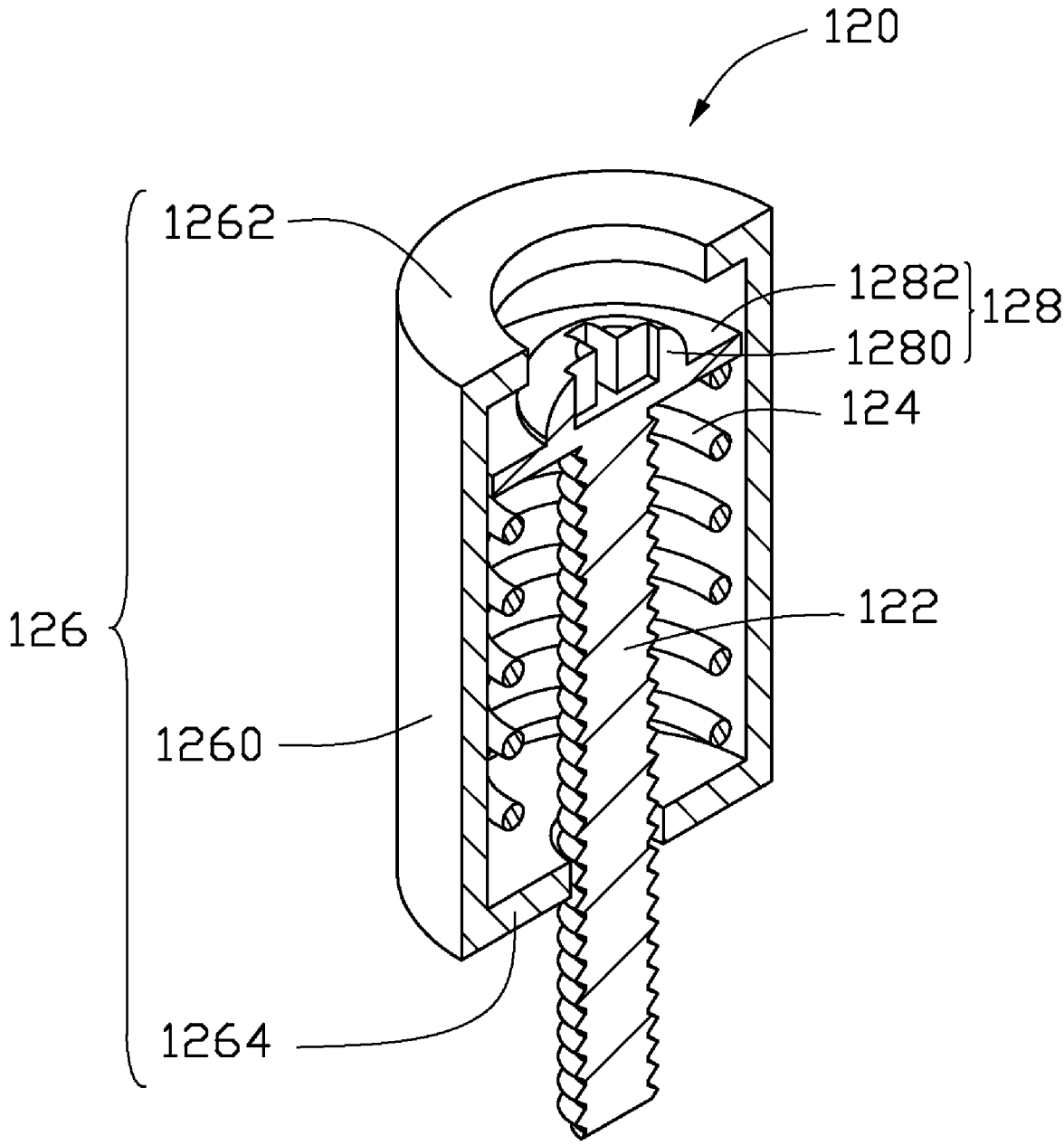
FIG. 4 is a cutaway, isometric view of a fastener of the LED lamp of FIG. 3.

Referring to FIGS. 2-4, a plurality of fasteners 120 fastens the bottom cover 50 on the bottom end of the heat sink 10. Each of the fasteners 120 comprises a shell 126, a helical spring 124 received in the shell 126 and a bolt (not labeled) extending through the helical spring 124. The bolt has a shaft 122 and a head 128 extending integrally from a bottom end of the shaft 122. The shaft 122 is machined with outer threads on an exterior thereof. The head 128 comprises a resisting portion 1282 abutting the helical spring 124 and an operating portion 1280 extending downwardly from a center of the resisting portion 1282. The shell 126 comprises a columnar sidewall 1260, a bottom wall 1262 and a top wall 1264 respectively, extending perpendicularly and inwardly from a bottom end and a top end of the sidewall 1260. An upper portion of the shaft 122 extends through the top wall 1264. The shell 126 encloses the shaft 122 and the helical spring 124 therein to form the fastener 120 as a single unit, wherein the helical spring 124 remains on the shaft 122. In use of the fastener 120, the shaft 122 moves in the shell 126 along a center axis of the shell 126. When the shaft 122 moves towards the top wall 1264 of the shell 126, the helical spring 122 is firmly sandwiched between the resisting portion 1282 of the head 128 and the top wall 1264. Alternatively, the shell 126 can be removed from the fastener 120, and the helical spring 122 can be replaced by other elastic members.

In assembly of the LED lamp, the LED modules 20 are mounted on the heat sink 10 via the fasteners 80. The bottom end of the heat sink 10 is received in the depression 52 of the bottom cover 50. The shafts 122 of the fasteners 120 extend through the through hole 502 and engage the threaded holes 146 of the conducting arms 14, so that the heat sink 10 is mounted on the bottom cover 50. The body 640 of the barrel 64 is inserted into the receiving space 620 of the seat 62, and the connecting flange 642 is mounted on the top portion of the seat 62 via the fasteners (not shown), so the lamp holder 60 is assembled. The driving circuit board 70 is mounted in the barrel 64 of the lamp holder 60. The bottom cover 50 with the heat sink 10 is mounted on a top portion of the lamp holder 60. The envelope 30 is coiled around the heat sink 10 and the bottom end of the envelope 30 is received in the receiving slot 54 of the bottom cover 50, wherein the second waterproof pad 110 is sandwiched between the bottom end of the envelope 30 and the receiving slot 54. The top cover 40 rests on the top end of the envelope 30, and the first waterproof pad 100 is sandwiched between the groove 422 of the top cover 40 and the rim 34 of the envelope 30. Simultaneously, the conducting piece 90 is sandwiched between the top cover 40 and the top end of the heat sink 10. A plurality of fasteners 48 extend sequentially through the through holes 420 of the top cover 42 and the corresponding extending holes 92 of the conducting piece 90 to threadedly engage in the threaded holes 146 defined at the top end of the conducting arms 14 so as to secure the top cover 42 and the conducting piece 90 on the top end of the heat sink 10.

The fasteners 48 are fastened towards the heat sink 10, and accordingly, the shaft 122 of the fastener 120 moves upwardly relative to the shell 126 of the fastener 120, with a gap between the top end of the heat sink 10 and the top cover 50 adjusted in assembly or during use of the LED lamp based on actual need. By fastening the fasteners 48 towards the heat sink 10, top cover 40 maintains tight contact with the top end of the heat sink 10, and simultaneously the first waterproof pad 100 and the second waterproof pad 110 are always tightly sandwiched between the top cover 40 and the top end of the envelope 30 and between the bottom cover 50 and the bottom end of the envelope 30. Thus, the LED lamp of the present disclosure meets demands of seal and heat dissipation.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp adapted for outdoor application comprising:

a heat sink;

a plurality of LED modules attached on the heat sink;

an envelope receiving the heat sink and the LED modules therein;

a top cover and a bottom cover located at two ends of the envelope, respectively;

a plurality of fasteners extending through the top cover and engaging one end of the heat sink;

a plurality of shafts extending though the bottom cover and engaging the other end of the heat sink, wherein an elastic member is coiled around each of the shafts;

a first waterproof pad sandwiched between the envelope and the top cover, and a second waterproof pad sandwiched between the envelope and the bottom cover;

wherein when the fasteners are fastened toward the heat sink, the elastic member moves relative to the shaft, whereby the heat sink makes tight contact with the top cover, and the first waterproof pad is tightly sandwiched between the envelope and the top cover, and the second waterproof pad is tightly sandwiched between the envelope and the bottom cover.

2. The LED lamp as claimed in claim 1 further comprising a shell enclosing the elastic member, wherein an end of each shaft extends to integrally present a head, each of the shafts extends through the shell, and the shell abuts the bottom cover, and the elastic member is sandwiched between the head and the shell.

3. The LED lamp as claimed in claim 2, wherein the shell comprises a sidewall enclosing the elastic member and each of the shafts, and a top wall and a bottom wall respectively extending from top and bottom ends of the sidewall, wherein each of the shafts extends through the top wall abutting the bottom cover.

4. The LED lamp as claimed in claim 3, wherein the elastic member is a helical spring.

5. The LED lamp as claimed in claim 1 further comprising a conducting piece is sandwiched between the top cover and the heat sink.

6. The LED lamp as claimed in claim 1, wherein the top cover defines a first receiving groove receiving the first waterproof pad, and the bottom cover defines a second receiving groove receiving the second waterproof pad, and two opposite ends of the envelope are respectively received in the first receiving groove of the top cover and the second receiving groove of the bottom cover, thereby sandwiching the first and second waterproof pads therebetween.

7. The LED lamp as claimed in claim 6, wherein the top cover comprises a heat spreader and a plurality of fins extending upwardly and radially from the heat spreader, and the fins are symmetrical relative to a central axis of the heat spreader.

8. The LED lamp as claimed in claim 7, wherein inner ends of the fins are spaced from a center of the heat spreader to define an empty area.

9. The LED lamp as claimed in claim 1 further comprising a lamp holder, wherein the lamp holder supports the bottom cover, the envelope and the top cover.

10. The LED lamp as claimed in claim 9, wherein the lamp holder comprises a barrel and a seat defining a receiving space receiving the barrel therein.

11. The LED lamp as claimed in claim 6, wherein the envelope is cylindrical with a top opening thereof larger than a lower opening at a bottom end thereof.

12. The LED lamp as claimed in claim 11, wherein a plurality of protrusions extend inwardly from an inner wall of the envelope.

13. The LED lamp as claimed in claim 12, wherein the protrusions are symmetrical relative to a central axis of the envelope.

14. The LED lamp as claimed in claim 13, wherein a rim extends outwardly and parallel to a top edge of the envelope, and is received in the first receiving groove of the top cover.

15. An LED lamp adapted for outdoor application comprising:

a heat sink;

a plurality of LED modules attached on the heat sink;

an envelope receiving the heat sink and the LED modules therein;

a top cover and a bottom cover located at two ends of the envelope, respectively;

a plurality of fasteners extending through the top cover and engaging one end of the heat sink; and a plurality of shafts extending though the bottom cover and engaging the other end of the heat sink, wherein an elastic member is coiled around each of the shafts;

wherein the top cover, the bottom cover and the envelope cooperatively form a sealed space receiving the heat sink and the LED modules therein, and when the fasteners are fastened toward the heat sink, the shafts move upwardly relative to the bottom cover, whereby a distance between the top cover and the heat sink is decreased so as to bring the heat sink into tight contact with the top cover.

* * * * *